US005704533A

United States Patent [19]

Chang

[11] Patent Number: 5,704,533

[45] Date of Patent: Jan. 6, 1998

[54] LEVER ACTUATED STAPLER

[76] Inventor: Chun Yuan Chang, 5F-1, No. 81, Sec. 2, Chern Der Road, Taipei, Taiwan

[21] Appl. No.: 805,927

[22] Filed: Feb. 25, 1997

[51] Int. Cl.[6] ..... B25C 5/11

[52] U.S. Cl. ..... 227/124; 227/134

[58] Field of Search ..... 227/120, 124, 227/134, 127, 128

[56] References Cited

U.S. PATENT DOCUMENTS

| | | | |
|---|---|---|---|
| 2,574,988 | 11/1951 | Vogel | 227/134 |
| 2,755,474 | 7/1956 | Spencer | 227/124 |
| 3,103,012 | 9/1963 | Kohen et al. | 227/124 |
| 3,368,731 | 2/1968 | La Pointe | 227/124 |
| 5,335,838 | 8/1994 | Harris et al. | 227/134 |

*Primary Examiner*—Scott A. Smith
*Attorney, Agent, or Firm*—Charles E. Baxley, Esq.

[57] ABSTRACT

A stapler includes a base and a chute and a cover pivotally coupled together at a rear pivot shaft. The base includes a roller extended downward beyond the middle portion. A lever includes a front portion pivotally coupled to the front portion of the cover and includes a rear handle for operating the lever, and including a block formed in the middle portion for engaging with the roller and for forcing the base toward the chute and the cover. The block includes a tapered surface for engaging with the roller and for allowing the user to operate the lever with less force.

1 Claim, 3 Drawing Sheets

LEVER ACTUATED STAPLER

BACKGROUND OF THE INVENTION

1. Field of the Invention

The present invention relates to a stapler, and more particularly to a lever actuated stapler.

2. Description of the Prior Art

Typical staplers comprise a base, a chute and a cover pivotally coupled together. The user is required to move the cover and the chute toward the base for to conducting stapling operation. However, normally, the user have to spend a great force for forcing the cover toward the base.

The present invention has arisen to mitigate and/or obviate the afore-described disadvantages of the conventional staplers.

SUMMARY OF THE INVENTION

The primary objective of the present invention is to provide a stapler having a lever actuator for facilitating the operation of the stapler.

In accordance with one aspect of the invention, there is provided a stapler comprising a base and a chute and a cover pivotally coupled together at a rear end with a pivot shaft, the cover including a front portion, the base including an inclined rear bottom and including a middle portion having a roller extended beyond the base, and a lever including a front portion pivotally coupled to the front portion of the cover at a pivot pin and including a rear portion having a handle for operating the lever, and including a middle portion having a block for engaging with the roller and for forcing the base toward the chute and the cover, the block including a tapered surface for engaging with the roller and for facilitating an operation of the lever. The user may spend less force to force the base toward the chute and the cover by the lever due to the engagement of the tapered surface of the block with the roller.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
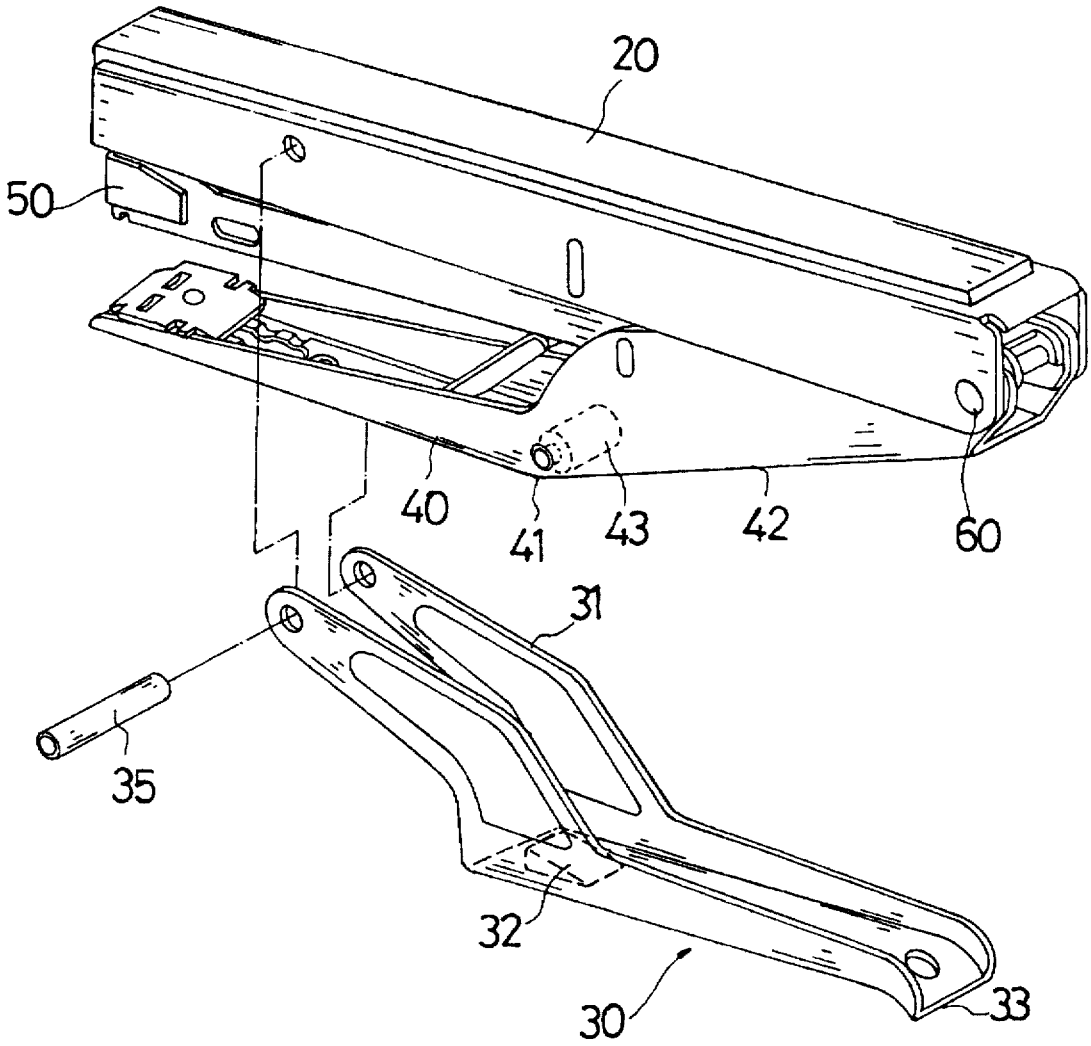
FIG. 1 is an exploded view of a stapler in accordance with the present invention.
Figure 2:
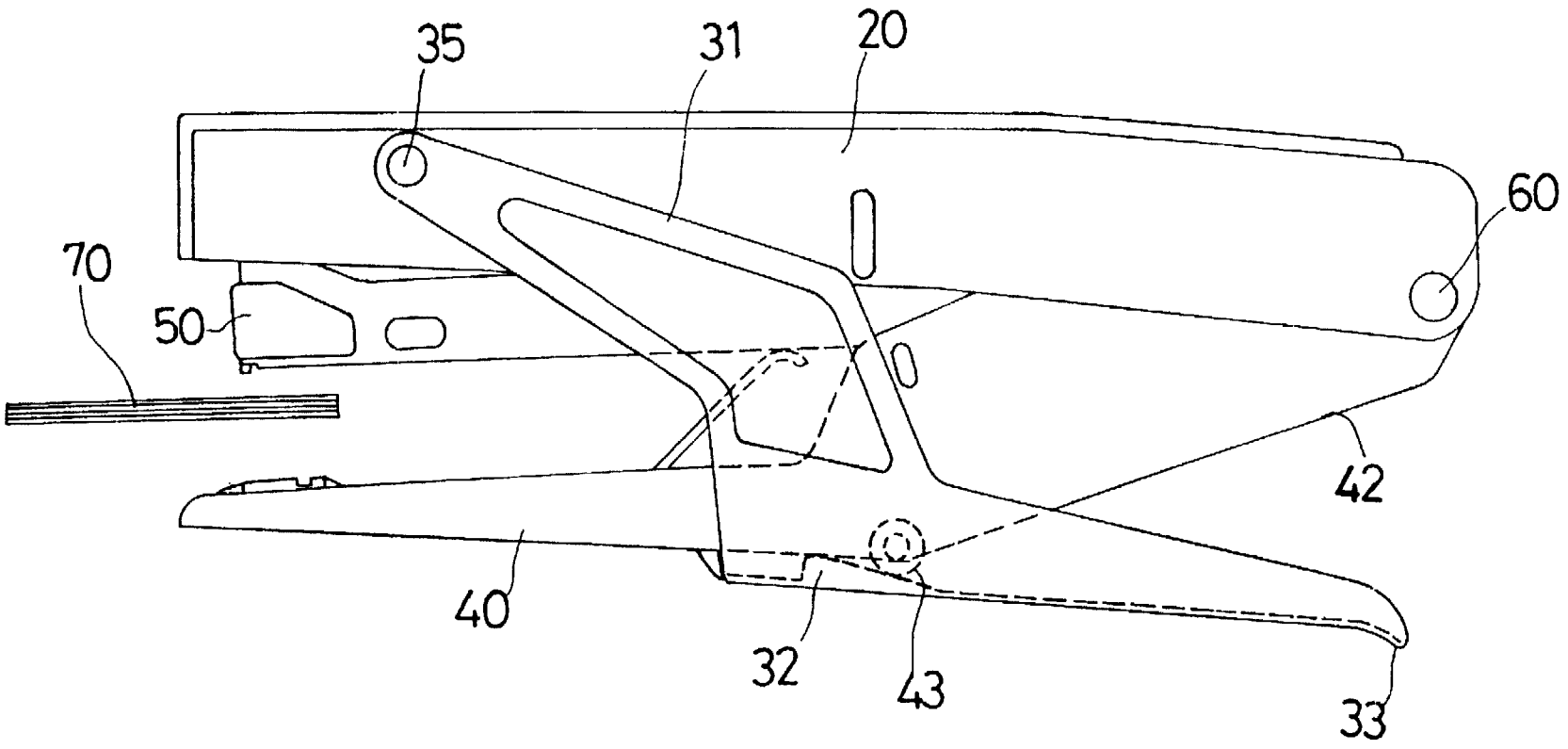
FIGS. 2 and 3 are plane views illustrating the operation of the stapler.

Referring to the drawings, and initially to FIGS. 1 and 2, a stapler in accordance with the present invention comprises a base 40, a chute 50 and a cover 20 pivotally coupled together at the rear end with a pivot shaft 60 for allowing the cover 20 and the chute 50 to be forced toward the base 40 for stapling the paper sheets 70. The base 40 includes a bent middle portion 41 for defining an inclined rear bottom 42. The base 40 includes a roller 43 rotatably secured in the middle portion and slightly extended downward beyond the base 40 (FIGS. 2 and 3).

A lever 30 includes a pair of panels 31 formed in the front portion and pivotally coupled to the front portion of the cover 20 at a pivot pin 35 for allowing the lever 30 to be rotated about the pivot pin 35 and for allowing the lever 30 to force the base 40 toward the chute 50 and the cover 20. The lever 30 includes a handle 33 formed in the rear portion and includes a block 32 having a tapered upper surface for engaging with the roller 43.

Figure 3:
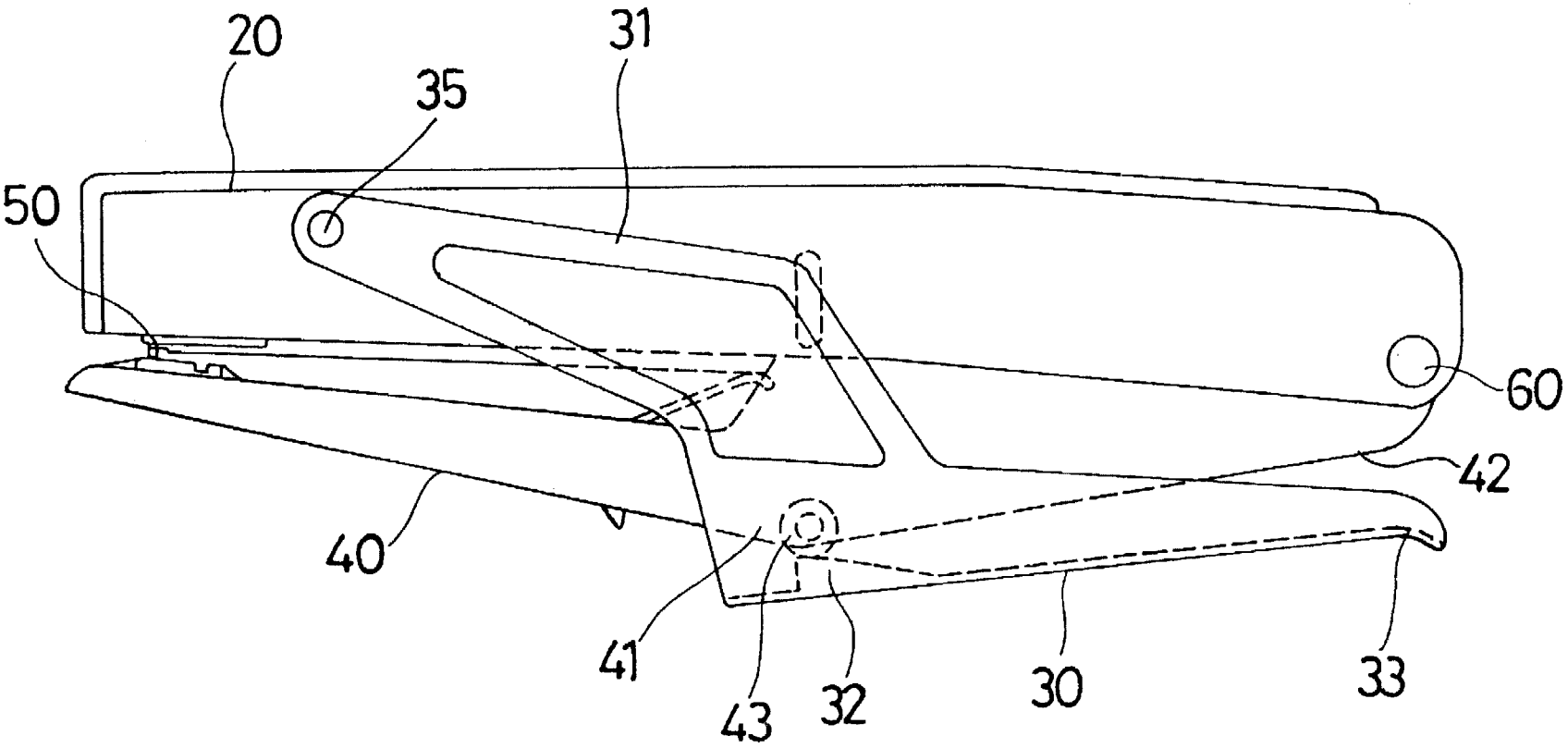

In operation, as shown in FIG. 3, when the handle 33 is forced toward the base 40, the block 32 may engage with the roller 43 for forcing the base 40toward the chute 50 and the cover 20 so as to conduct stapling operation. It is to be noted that the tapered upper surface may facilitate the upward actuating operation to the base 40 such that the user may use less force to operate the stapler.

Accordingly, the stapler in accordance with the present invention includes a lever for operating the stapler, and the lever includes a block having a tapered upper surface for engaging with the base and for facilitating the operation of the stapler and for allowing the user to operate the stapler with less force.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A stapler comprising:

a base and a chute and a cover pivotally coupled together at a rear end with a pivot shaft, said cover including a front portion, said base including an inclined rear bottom and including a middle portion having a roller extended beyond said base, and a lever including a front portion pivotally coupled to said front portion of said cover at a pivot pin and including a rear portion having a handle for operating said lever, and including a middle portion having a block for engaging with said roller and for forcing said base toward said chute and said cover, said block including a tapered surface for engaging with said roller and for facilitating an operation of said lever.

* * * * *